United States Patent [19]

Harrold

[11] Patent Number: 5,012,195

[45] Date of Patent: Apr. 30, 1991

[54] METHOD FOR IMPROVING THE ELECTRICAL STRENGTH OF VAPOR-MIST DIELECTRICS

[75] Inventor: Ronald T. Harrold, Murryville Boro, Pa.

[73] Assignee: ABB Power T&D Company, Inc., Blue Bell, Pa.

[21] Appl. No.: 458,264

[22] Filed: Dec. 28, 1989

[51] Int. Cl.[5] ..... B01R 31/12

[52] U.S. Cl. ..... 324/553; 324/459; 361/2; 361/228

[58] Field of Search ..... 324/551, 553, 452–455, 324/464, 469, 459; 361/1, 2, 14, 228; 427/12, 13, 35, 77, 78

[56] References Cited

U.S. PATENT DOCUMENTS

| | | | |
|---|---|---|---|
| 2,853,540 | 9/1958 | Camilli et al. | 174/17 |
| 2,990,443 | 6/1961 | Camilli | 174/15 |
| 3,684,951 | 8/1972 | Harrold | 324/52 |
| 3,728,619 | 4/1973 | Harrold et al. | 324/52 |
| 3,978,397 | 8/1976 | Burry et al. | 324/469 |
| 4,156,846 | 5/1979 | Harrold et al. | 324/51 X |
| 4,158,168 | 6/1979 | Harrold | 324/52 |
| 4,158,169 | 6/1979 | Harrold et al. | 324/52 |
| 4,162,227 | 7/1979 | Cooke | 252/63.5 |
| 4,296,003 | 10/1981 | Harrold et al. | 252/570 |
| 4,320,035 | 3/1982 | Harrold | 252/574 |
| 4,350,838 | 9/1982 | Harrold | 174/15 R |
| 4,440,971 | 4/1984 | Harrold | 176/17 G F |

OTHER PUBLICATIONS

Cawood et al., A Curious Phenomenon Shown by Highly Charged Aerosols, Nature 128 (3221) p. 150, 7-1931.

Harrold, Physicals Aspects of Vapor Mist Dielectrics, IEEE Trans. on Ind. Appl., IA-22(1), pp. 63-69, Jan.-/Feb. 1986.

Harrold, Partial Discharge Supression in Vapor-Mist Dielectrics, Conf. on Elect. Ins. and Diel. Phen., pp. 364-374, 12/1984.

Harrold, Vapor-Mist Dielectrics, Conf. on elect. Ins. and Diel. Phen. pp. 362-376, 12/1981.

*Primary Examiner*—Kenneth Wieder
*Assistant Examiner*—Jack B. Harvey
*Attorney, Agent, or Firm*—Ostrolenk, Faber, Gerb & Soffen

[57] ABSTRACT

A method in which ionization associated with fine wire or solid electrode systems causes mist droplets to charge and collect on electrode surfaces or at a region of highest electrical stress. The method includes manipulating droplet clouds to reach high stress regions. This process achieves improved electrical strength by depositing a mist in optimum locations before voltage applications.

12 Claims, 1 Drawing Sheet

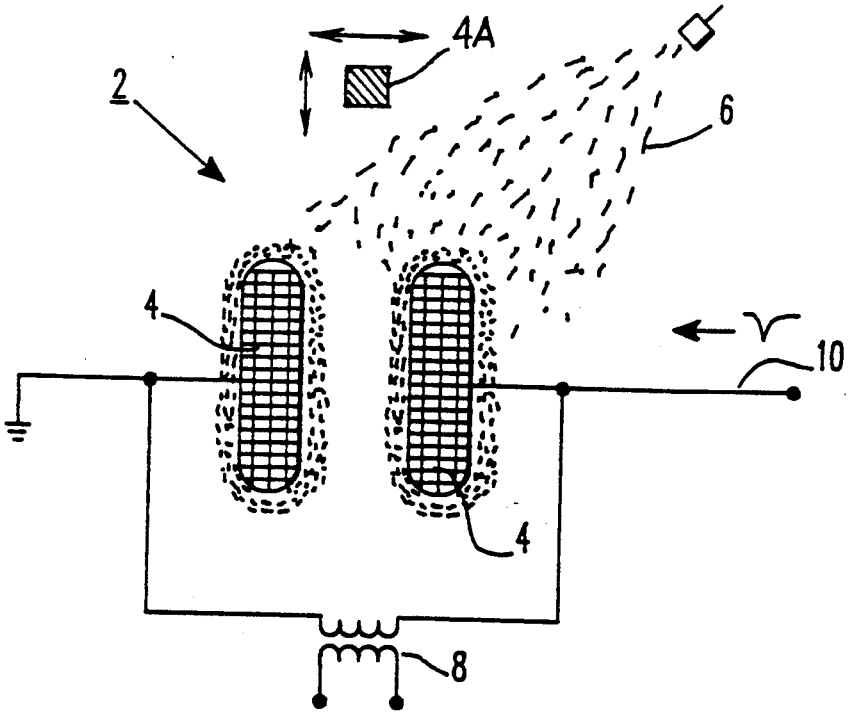
4A
2
6
4
10
4
8

METHOD FOR IMPROVING THE ELECTRICAL STRENGTH OF VAPOR-MIST DIELECTRICS

BACKGROUND OF THE INVENTION

1. Field of the Invention

The present invention relates to vapor-mist dielectrics, and more specifically to improved electrical strength of vapor-mist dielectrics before voltage application.

2. The Prior Art

The electrical strength of vapor-mist dielectrics results from a combination of the vapor from the droplets enhancing the gas strength and the droplets collecting electrons and ions. The droplets collecting electrons and ions helps prevent the formation of electron avalanches which precede breakdown. Generally, as the mist density increases, the electron collecting properties are enhanced and more electron avalanches are extinguished, and the electrical breakdown strength is improved. Ideally the highest density of mist should be near the electrode surfaces where the electrical stress is highest.

In addition, it is well known that gases such as $SF_6$ have increased AC breakdown strength in non-uniform fields by corona stabilization or a space charge which develops around sharp edged electrodes. In this way, a needlepoint electrode appears more as a spherical shape at the tip and the AC breakdown strength of certain non-uniform field gaps approaches that of uniform fields. This approach using fine wire electrodes in various electrode configurations has been used. See Uhlig, "The Ultra Corona Discharge, A New Discharge Phenomena Occurring on Thin Wires" *National Research Counsel of Canada,* 1956, pp. 15-1-15-3. The problem with using fine wire electrodes with power frequency voltages is that a large amount of electrical energy is consumed in generating the required amount of space charge and the system therefore is very inefficient. Also, this method is not adaptable to work under impulse voltage (lasting only microseconds) conditions because there is insufficient time for the necessary space charge to form. An advantage in using vapor-mist with fine wire instead of solid electrodes is better uniformity and flow of mist as it can pass through the electrode body.

There remains therefore a need for improving the electrical strength and performance of vapor-mist by ensuring that the most dense mist is at the electrode surfaces, or regions of highest electrical stress before the application of electrical voltages. Also, there is a need for utilizing fine wire electrode systems without excessive energy consumption at power frequency voltages and also for using fine wire systems with short time impulse voltages.

SUMMARY OF THE INVENTION

The present invention discloses a method in which ionization associated with fine wire electrode systems causes mist droplets to charge and collect on electrode surfaces or at a region of highest electrical stress. The method manipulates droplet clouds to reach high stress regions resulting in improved electrical strength by depositing mist in optimum locations before voltage applications.

It is an object of the present invention to provide a method for improving the electrical strength of vapor-mist dielectrics.

It is another object of the present invention to provide an apparatus suitable for use in vapor-mist dielectrics.

It is another object of the present invention to provide an efficient vapor-mist dielectric.

It is another object of this invention to allow the efficient use of fine wire uniform or non-uniform field electrode systems.

These and other objects of the present invention will be seen upon review of the description of the invention.

BRIEF DESCRIPTION OF THE DRAWING

The Figure illustrates a presently preferred embodiment of a vapor mist dielectric apparatus before system voltage is applied.

DETAILED DESCRIPTION OF THE PREFERRED EMBODIMENTS

The electrical strength of a vapor mist dielectric may be improved by the use of electrodes, preferably fine wire or solid electrodes, generally parallelly spaced, a mist supply disposed proximate to the electrodes and an ionization means. The mist supply generates mist droplets with the electrodes surrounded by a gaseous dielectric the ionization means applies electrons to the gas molecules which deposit on mist droplets which go to regions of high electrical stress. Thereafter, system voltage may be applied. The mist droplets are preferably a liquid dielectric such as $C_2Cl_3F_3$ or $C_8F_{16}O$. The ionization means may be a transformer which provides a source of AC or a source of DC voltage. Alternatively, the ionization means may be a coating of polonium on the electrodes. Specifically, the ionization means ionizes gas molecules which then collect on the mist droplets and charges them. This method may also be used to extinguish a partial discharge. Moreover, the method may move mist droplets by DC voltage to areas of high electrical stress by means of an electrical field. A separate moveable electrode may be used to move the droplets to a new location.

It is known that AC corona at a point electrode in $SF_6$ is rapidly suppressed by the application of mist. Thereafter, the applied electrical stress can be increased by a factor of three without any corona occurring. See Harrold "Partial Discharge Suppression in Vapor-Mist Dielectrics", CEIDP, Ann. Rep. Oct. 1984. It is believed that as the micron size mist droplets approach the point, due to ionization of gas molecules near that point, the droplets acquire a charge and immediately migrate to and cling to the point, or more to the region of highest electrical stress. The highly stressed needle electrode becomes coated with liquid which prevents electron emission from the surface and tends to stress grade the tip of the needle.

In order to increase the impulse strength of vapor mist, the uniform field electrodes are formed from closely spaced fine wires and the region close to the wires should be ionized. Ionization may preferably occur by AC or DC voltage of about 1 to 10 kV depending upon the wire diameter (for example, a 3 mil diameter wire at 5 to 10 kV AC). Alternatively, a coating of polonium (ionization by radiation) on the wire, or any other means of ionization (for example, droplets acquiring a charge by turboelectric or friction) effects when liquid is atomized by being forced through a nozzle). When mist is applied to this system, the droplets will charge and collect on the fine wire electrode surface. The mist is preferably a dielectric fluid and more preferably may be in an electronegative gas, an electropositive gas or a mixture thereof. Suitable dielectric fluids and gases include $SF_6$, $C_2Cl_3F_3$, $C_8F_{16}O$, $CF_4$, $CF_3Cl$, $N_2CO_2$ or mixtures thereof. The most preferred liquid dielectrics are $C_8F_{16}O$ and $C_2Cl_3F_3$. Then the system voltage, such as power frequency or impulse is applied.

As mist droplets readily collect on the electrode surfaces around which the gas is ionized, it may be desirable to charge the mist droplets as they are generated. Then by application of appropriate voltage fields, the cloud of charge particles may be held in an unused position. The Figure shows a presently preferred embodiment of a vapor-mist dielectric of the present invention. The apparatus 2 has two uniform field wire mesh or solid electrodes 4. A mist supply 6 disposed proximate to the electrodes provides the appropriate misting of the electrodes 4. The electrodes 4 are spaced at an appropriate generally parallel distance.

An appropriate voltage transformer 8, which is electrically isolated from ground and supplies sufficient voltage to the electrodes 4 so that the gas surrounding the electrodes 4 is ionized. Mist droplets collect at the electrodes 4, because the droplets collect a charge from ionization near the wires and are then attracted to the wire. Thereafter an impulse voltage or other desired voltage 10 is applied to the electrodes 4. If another means of ionization is used, then the charged mist droplets will collect on or near the electrodes 4 when the actual test voltage is applied.

It will be appreciated that due to ionization at electrodes and droplets charging, a dense mist will collect at the fine wire or solid electrode surface or at regions of highest electrical stress, prior to the application of system voltage. Mist droplets can be generated and the droplets charged and held by appropriate electrical fields in a particular location for later use. Mist droplets which have been charged and stored can be manipulated by appropriate electrical fields and moved to areas of high electrical stress when desired, either before the application of voltage, or during operation under voltage, when it is desired to extinguish a source of microsparking (corona or partial discharges). A separate movable electrode 4A may be used to move the droplets to a new location.

Whereas, particular embodiments of the invention have been described above for purposes of illustration, it will be appreciated by those skilled in the art that numerous variations of the details may be made without departing from the invention as described in the appended claims.

I claim:

1. A method for improving the electrical strength of vapor mist dielectric comprising:

providing electrodes generally parallelly spaced, a mist supply disposed proximate to said electrodes and an ionization means;

generating mist droplets from said mist supply with said electrodes surrounded by a gaseous dielectric;

ionizing the gaseous dielectric, charging the droplets and depositing said mist at regions of high electrical stress; and applying system voltage after ionizing the gaseous dielectic, and charging said droplets.

2. A method of claim 1 wherein said electrodes consist of a plurality of fine wires.

3. The method of claim 1 including providing a gas selected from $N_2$ or $SF_6$ as said gaseous dielectric.

4. The method of claim 1 including providing a transformer as said ionization means.

5. The method of claim 1 including providing a source of AC voltage as said ionization means.

6. The method of claim 4 including generating said mist droplets and holding said mist droplets in position by an electric field generated by said transformer.

7. The method of claim 4 including providing sufficient voltage by said transformer to ionize said gaseous dielectic. which then collect on said mist droplets charge them.

8. The method of claim 7 including providing said transformer which is electrically isolated from ground.

9. The method of claim 1 including coating said electrodes with polonium as said ionization means.

10. The method of claim 1 including providing $C_8F_{16}O$ or $C_2Cl_3F_3$ as said mist droplets.

11. A method of extinguishing a partial discharge at a region of high electrical stress comprising:

providing fine wire electrodes generally parallelly spaced, a mist supply disposed proximate to said electrodes and an ionization means;

generating mist droplets with said electrodes surrounded by a gaseous dielectric;

applying a voltage to said electrodes and ionizing the gaseous dielectric, charging the droplets and moving said mist droplets to areas of high electrical stress by an electrical field; and applying system voltage after moving said mist droplets to said areas of high electrical stress.

12. The method of claim 11 including using a separate moveable electrode energized with a DC voltage to push the charged droplets to a new location.

* * * * *